United States Patent [19]

Bull et al.

[11] 3,997,422

[45] Dec. 14, 1976

[54] COMBINATION COAL DEASHING AND COKING PROCESS

[75] Inventors: Willard C. Bull, McCandless Township, Pa.; Vaughn L. Bullough, Florence, Ala.

[73] Assignees: Gulf Oil Corporation, Pittsburgh, Pa.; Reynolds Metals Company, Richmond, Va.

[22] Filed: June 20, 1975

[21] Appl. No.: 588,809

[52] U.S. Cl. ..... 208/8; 208/50

[51] Int. Cl.[2] ..... C10G 1/06

[58] Field of Search ..... 208/8, 50

[56] References Cited

UNITED STATES PATENTS

| | | | |
|---|---|---|---|
| 2,073,367 | 3/1937 | Fisher | 208/8 |
| 3,240,566 | 3/1966 | Bullough et al. | 208/8 |
| 3,341,447 | 9/1967 | Bull et al. | 208/8 |
| 3,503,864 | 3/1970 | Nelson | 208/8 |
| 3,518,182 | 6/1970 | Paterson | 208/8 |
| 3,687,837 | 8/1972 | Fiocco et al. | 208/8 |
| 3,884,795 | 5/1975 | Wright et al. | 208/8 |

*Primary Examiner*—Delbert E. Gantz
*Assistant Examiner*—James W. Hellwege

[57] ABSTRACT

Deashed solid coal effluent from a coal solvent deashing process in which raw coal is converted to deashed solid and liquid coal is passed to a delayed coker. The coker operates at a higher temperature than is employed in the solvent deashing process and produces deashed coke, liquid hydrocarbonaceous material including solvent boiling range liquid and hydrogen-containing gas. The hydrogen produced in the coker is derived from hydrogen which was previously consumed in the deashing step and can also include hydrogen contained in the raw coal. The solvent boiling range liquid and hydrogen produced in the coker are recycled to the solvent deashing step. Since the coker supplies a portion of the solvent required in the deashing step, the deashing step is operated to produce only a portion of its recycle liquid solvent requirement, thereby conserving hydrogen.

12 Claims, 7 Drawing Figures

COMBINATION COAL DEASHING AND COKING PROCESS

This invention relates to a combination coal solvent deashing and delayed coking process.

In accordance with the present invention coal is first solvent deashed and desulfurized in the presence of added hydrogen to produce a low hydrogen-content deashed coal which is solid at room temperature. A low-ash low-sulfur solid coal is the primary solvation product, but a smaller quantity of normally liquid product is also produced, together with some gases. Some or all of the normally solid deashed coal is passed to a delayed coker which is operated at a higher temperature than is employed in the solvent deashing process and without added hydrogen. In the coker, the solid coal is subjected to thermal cracking to produce normally liquid hydrocarbon, a hydrogen-containing gas and low-ash low-sulfur coke. The coke can be passed to a calciner for conversion to a calcined coke which meets commercial metal and sulfur specifications for use as an electrode in the manufacture, for example, of aluminum.

The coke recovered from the thermal coker has a lower hydrogen content than the deashed solid coal supplied to the coker, accounting for the hydrogen make in the coker. The hydrogen produced in the coker constitutes at least a partial recovery of the gaseous hydrogen combined with the deashed coal in the solvent deashing step and may also include hydrogen present in the raw coal. The coker hydrogen is purified and recycled to the solvent deashing process and can typically constitute up to 30 percent, or more, of the hydrogen requirement of the solvent deashing step. Substantially the entire coker hydrocarbonaceous liquid product boiling in the deashing solvent range is also recycled to the deashing process, wherein it constitutes a portion of the total process solvent. If this portion of the total quantity of liquid solvent were produced in the solvent deashing step, its production would require a net consumption, rather than a net production, of hydrogen.

The present invention takes advantage of the production of liquid boiling in the deashing solvent range in a thermal coking step, and of the fact that this liquid has good hydrogen donor qualities as required by a solvent in the deashing step, by recycling this solvent boiling range liquid to the solvent deashing step and by modifying operation of the solvent deashing process to integrate the coker and the solvent deashing operations into highly interdependent combination processes which together produce substantially no more than the total requirements of solvent boiling range liquid.

In accordance with the present invention, the operation of the solvent deashing step is modified to derive a high measure of advantage from the recycle of the coker solvent liquid. In the absence of recycle of coker solvent boiling range oil, the solvent deashing step would have to produce its full complement of solvent liquid for recycle. Solvent liquid can boil at 200° or 260° C.+. It can comprise a fraction having an upper boiling limit of 400° or 427° to 540° C. Other boiling ranges are also suitable for solvent liquid. Whatever the boiling range, the solvent liquid which is produced in the solvent deashing operation is obtained by hydrocracking of deashed normally solid coal. Such hydrocracking consumes hydrogen by converting relatively low-hydrogen content deashed solid coal to higher-hydrogen content liquid coal. For the solvent deashing operation to produce its full requirement of solvent liquid, relatively severe conditions of temperature, hydrogen pressure and residence time are required in the solvent deashing operation. With the coker as an external source of solvent liquid, one or more of these conditions in the solvent deashing operation can be moderated to the extent that the solvent deashing operation produces less than 100 percent of recycle solvent boiling range liquid requirements. The more mild deashing process conditions in the solvent deashing operation result in a reduced hydrogen consumption.

Since substantially all the solvent boiling range liquid produced in both the solvent deashing and coker steps is recycled and these two supplies constitute the total recycle solvent stream, as the proportion of the solvent liquid requirement which is produced in the coker increases, the solvent deashing conditions are rendered correspondingly more mild to reduce solid to liquid conversion therein, and correspondingly save hydrogen. Thereby, any or all of the solvent deashing conditions including temperature, hydrogen pressure and residence time can be moderated so that a reduced quantity of normally solid coal is hydrocracked to normally liquid material for recycle as a solvent. To illustrate the effect of pressure severity on liquid yield, in one example it was found that the solvent deashing pressure had to be increased from 105 to 175 kg/cm$^2$ to increase solvent yield 2.2 percent, based on MAF coal, while a decrease in pressure from 105 to 70 kg/cm$^2$ reduced solvent yield 8.2 weight percent. To illustrate the effect of temperature severity, in one example an increase in temperature from 427° to 441° C. was required to increase solvent yield 4.2 weight percent. An attached figure, discussed below, shows graphically that moderation of solvent deashing temperature and space times can result in a considerable savings in hydrogen. The figure shows that in the solvent deashing step, which is performed in the presence of added hydrogen, at elevated temperatures the increase in hydrogen consumption with increasing space time is extremely rapid due to hydrocracking. The figure (FIG. 6) shows in particular that where conversion of solid to liquid coal requires temperatures above 450° or 475° C. it is critical to hydrogen economy to defer such conversion for a subsequent thermal coking step performed without added hydrogen. When the thermal coking step is performed above the highest temperature employed in the solvent deashing process, solid coal is converted in addition to coke to liquid coal with concomitant freeing of a portion of the hydrogen consumed in the solvent deashing process and perhaps some of the hydrogen from the raw coal, so that liquid solvent is produced not only without consuming hydrogen but with a net production of hydrogen.

The process deficiency in solvent resulting from the mild solvent deashing conditions is compensated by delayed coking of the deashed solid coal without added hydrogen, so that the deficiency in solvent liquid is produced not only without hydrogen consumption but with partial recovery of the hydrogen previously consumed in the deashing step. This hydrogen recovered in the coker is recycled to the deashing step. Since solvent produced in the solvent deasher consumes hydrogen while solvent produced in the coker is accompanied by hydrogen production, there is a double hydrogen economy in the combination process of this invention. Furthermore, as indicated above, this double hydrogen economy is coupled with considerably milder solvent deashing conditions than if total process solvent requirements were obtained in the deashing step.

If all of the deashed solid coal produced in the solvent deashing process is coked, in addition to the coke yield sufficient solvent boiling range oil is produced in the coker to satisfy about 5 percent of the solvent needs of the deashing process and concomitantly the coker produces about 30 percent of hydrogen requirements for the deashing step. Recycle of the entire solvent liquid and hydrogen make from the coker to the solvent deasher permits solvent deashing conditions to be moderated so that only about 95 percent of total solvent requirements are produced in the deasher, resulting in an additional net savings in hydrogen. Even under the more mild conditions, the normally solid coal product produced in the solvent deashing operation will still be sufficiently low in metals and sulfur content to meet specifications for commercial grade aluminum electrode coke. The entire solvent boiling range liquid product from both the coker and solvent deashing process is recycled and constitutes the entire solvent stream. For example, the 200° to 540° C. distillate fraction from each operation can be recycled for use as a solvent. The full hydrogen make from the coker, after purification, can also be recycled so that 30 percent or more of process hydrogen requirements are satisified thereby.

Following is a description of an advantageous noncatalytic solvent deashing process for producing reduced or low ash and sulfur hydrocarbonaceous solid fuel and hydrocarbonaceous distillate liquid from ash- and sulfur-containing raw coal. Preferred coal feeds for this solvation process contain hydrogen, such as bituminous and sub-bituminous coals, and lignites. The process produces deashed solid coal (dissolved coal) together with only as much coal-derived solvent boiling range liquid as is necessitated by the yield of solvent boiling range liquid produced in the downstream coking step, with an increase in liquid coal product being accompanied by a decrease in solid coal product.

Severe solvent deashing process conditions disadvantageously encourage production of not only unrequired solvent but also of undesired by-product hydrocarbon gases. Hydrocarbon gases have a greater hydrogen to carbon ratio than either solid or liquid coal so that their production is not only wasteful of other hydrocarbonaceous product but is also wasteful of hydrogen. Hydrocarbon gases and solvent liquid are both produced by hydrocracking, and since the production of such gases as well as unrequired solvent is undesired in this process no external catalyst is employed, since catalysts generally impart hydrocracking activity in a coal solvation process.

When the raw coal is subjected to solvation in the deashing process described herein at a relatively low temperature, the dissolved product comprises in major proportion deashed high molecular weight polymer coal which is solid at room temperature. When the mixture of solvent and dissolved coal is subsequently filtered to remove ash and undissolved coal and the filtrate is then subjected to vacuum distillation, this high boiling solid fuel product is recovered as the vacuum bottoms. This deashed vacuum bottoms product is referred to herein as either vacuum bottoms or deashed solid coal. This deashed solid coal is employed as coker feed. If a portion of the vacuum bottoms is desired for use as a fuel, it is solidified by cooling to room temperature on a conveyor belt and is scraped from the belt as fragmented deashed hydrocarbonaceous solid fuel. As the temperature of the solvation deashing process is progressively increased, the vaccum bottoms is converted to lower molecular weight hydrocarbonaceous liquid which constitutes a recycle solvent for raw feed coal.

In the deashing data presented below the term "excess solvent" refers to the solvent boiling range liquid yield above or below the amount required for recycle. This term will be positive when the deashing process produces more liquid than is required for recycle. When the deashing process does not produce its full solvent requirement, the excess solvent value will be negative. When the deashing process produces 100 percent of its own recycle solvent requirement, the excess solvent value will be zero. Therefore, if the coker produces 5 percent of the total solvent requirement, the deasher excess solvent yield will be about −5 percent, meaning that the deasher solvent yield is 5 percent below full recycle requirements.

The solvation process in which the excess solvent data was taken employs a high length to diameter ratio tubular reactor which permits precise control of residence time. The data presented below show that the precise control of residence time achieved by employing a high length to diameter tubular reactor enables facile establishment of any desired negative "excess solvent" yield in the deashing process, so that the degree of deficiency in solvent make in the solvation step can be carefully controlled in response to solvent production in the coker.

Production of the solvent can occur by depolymerization of solid fuel through various reactions, in addition to hydrogenolysis, such as removal therefrom of heteroatoms, including sulfur and oxygen. As a result of either hydrocracking or depolymerization reactions, the liquid coal has a higher hydrogen to carbon ratio than the solid fuel. The present process converts only as much of the vacuum bottoms to solvent boiling range liquid as is required to satisfy process solvent requirements, since production of liquid product requires elevated process severity and consumes hydrogen.

It is the purpose of the present invention to avoid hydrocracking during the solvent deashing step as much as possible and at least to the extent of avoiding excessive production of both normally liquid product and hydrocarbon gases in order to conserve hydrogen. This purpose can be accomplished by performing the solvation operation in two separate stages. The second stage employs a longer residence time than the first stage. If desired, the first stage can have a higher temperature than the second stage. Also, if desired, the second stage can have a relatively higher hydrogen pressure than the first stage. In addition, the deashing stages can utilize recycle of some of the removed ash, or permit some removed ash to accumulate in the deashing process, since the FeS in the ash exerts a catalytic desulfurization effect.

The first reactor stage of the solvent deashing process comprises a tubular preheater having a relatively short residence time in which a slurry of feed coal and solvent in essentially plug flow is progressively increased in temperature as it flows through the tube. The tubular preheater has a length to diameter ratio of at least 100, generally, and at least 1,000, preferably. A series of different reactions occur within a flowing stream increment as the temperature of the increment increases from a low inlet temperature to a maximum or exit temperature, at which it remains for only a short time. The second solvent deashing stage employs a relatively longer residence time in a larger vessel maintained at a substantially uniform temperature throughout. If desired, a regulated amount of forced cooling occurs between the stages so that the second stage temperature is lower than the maximum preheater temperature. Although the preheater stage is operated with plug flow without significant backmixing, full solution mixing with a uniform reactor temperature occurs in the dissolver stage.

The coal solvent for the solvation process comprises liquid hydroaromatic compounds. The coal is slurried with the solvent for charging to the first or preheater stage. In the first stage, hydrogen transfer from the solvent hydroaromatic compounds to coal hydrocarbonaceous material occurs resulting in swelling of the coal and in breaking away of hydrocarbon polymers from coal minerals. Maximum temperatures suitable in the first (preheater) stage are generally 400° to 500° C., preferably 425° to 500° C., and most preferably, the upper temperature limit should be 470° C., or below. The residence time in the preheater stage is generally 0.01 to 0.25 hours, or preferably 0.01 to 0.15 hours.

In the second (dissolver) stage of the solvation process, the solvent compounds, which have been depleted of hydrogen and converted to their precursor aromatics by hydrogen donation to the coal in the first stage, are reacted with gaseous hydrogen and reconverted to hydroaromatics for recycle to the first stage. The temperature in the dissolver stage can be 350° to 475° C., generally, and 400 to 450° C., preferably. The residence time in the dissolver stage is 0.1 to 3.0 hours, generally, and 0.15 to 1.0 hours, preferably. The temperature in the dissolver stage can be lower than the maximum temperature in the preheater stage. Any suitable forced cooling step can be employed to reduce the stream temperature between the preheater and dissolver. For example, makeup hydrogen can be charged to the process between the preheater and dissolver stages or a heat exchanger can be employed. Also, the residence time in the preheater is lower than the residence time in the dissolver.

The liquid space velocity for the solvation process (volume of slurry per hour per volume of reactor) ranges from 0.2 to 8.0, generally, and 0.5 to 3.0, preferably. The ratio of hydrogen to slurry ranges from 3.6 to 180 standard cubic meters per 100 liters, generally, and 9 to 90 standard cubic meters per 100 liters, preferably. The weight ratio of total recycle solvent to coal in the feed slurry, including solvent from both the solvation and coking steps, ranges from 0.5:1 to 5:1, generally, and from 1.0:1 to 2.5:1, preferably.

The reactions in both solvation stages occur in the presence of gaseous hydrogen and in both solvation stages heteroatom sulfur and oxygen are removed from solvated deashed coal polymer, resulting in depolymerization and conversion of dissolved coal polymers to desulfurized and deoxygenated free radicals of reduced molecular weight. These free radicals have a tendency to repolymerize at the high temperatures reached in the preheater stage, but if the temperature of the dissolver stage is reduced these free radicals tend to be stabilized against repolymerization by accepting hydrogen at the free radical site. The solvation process can employ carbon monoxide and steam together with or in place of hydrogen since carbon monoxide and steam can react to form hydrogen. The steam can be derived from feeding wet coal or can be injected as water. The reaction of hydrogen at the free radical site occurs more readily at the relatively low dissolver temperature than at the higher preheater exit temperature.

The solvent used at process start-up is advantageously derived from coal. Its composition will vary, depending on the properties of the coal from which it is derived. In general, the solvent is a highly aromatic liquid obtained from the previous processing of coal, and generally boils within the range of about 200° or 260° to 450° C., or higher. Other generalized characteristics include a density of about 1.1 and a carbon to hydrogen mole ratio in the range from about 1.0 to 0.9 to about 1.0 to 0.3. Any organic solvent for coal can be used as the start-up solvent in the process. A solvent found particularly useful as a start-up solvent is anthracene oil or creosote oil having a boiling range of about 220° C. to 400° C. However, the start-up solvent is only a temporary process component since in the course of the process dissolved fractions of the raw coal and coker distillate constitute additional solvent which, when added to start-up solvent, provide a total amount of solvent at least equaling the amount of start-up solvent. Thus, the original solvent gradually loses its identity and the system solvent evolves to the constitution of the solvent formed by solution and depolymerization or hydrocracking of the coal in the solvation process plus the solvent derived from the coker.

Although the duration of the solvation process can vary for each particular coal treated, viscosity changes as the slurry flows along the length of the preheater tube provide a parameter to define slurry residence time in the preheater stage. The viscosity of an increment of feed solution flowing through the preheater initially increases with increasing increment time in the preheater, followed by a decrease in viscosity as the solubilizing of the slurry is continued. The viscosity would rise again at the preheater temperature, but preheater residence time is terminated before a second relatively large increase in viscosity is permitted to occur. As advantageous means for establishing proper time for termination of the preheater step in use of the "Relative Viscosity" of the solution formed in the preheater, which is the ratio of the viscosity of the solution formed to the viscosity of the solvent, as fed to the process, both viscosities being measured at 99° C. Accordingly, the term "Relative Viscosity" as used herein is defined as the viscosity at 99° C., of an increment of solution, divided by the viscosity of the solvent alone fed to the system measured at 99° C., i.e.

$$\text{Relative Viscosity} = \frac{\text{Viscosity of Solution at 99° C.}}{\text{Viscosity of Solvent at 99° C.}}$$

The "Relative Viscosity" can be employed as an indication of the residence time for the solution in the preheater. As the solubilizing of an increment of slurry proceeds during flow through the preheater, the "Relative Viscosity" of the solution first rises above a value of 20 to a point at which the solution is extremely viscous and in a gel-like condition. In fact, if low solvent to coal ratios are used, for example, 0.5:1, the slurry would set up into a gel. After reaching the maximum "Relative Viscosity", well above the value of 20, the "Relative Viscosity" of the increment begins to decrease to a minimum, after which it has a tendency to again rise to higher values. The solubilization proceeds until the decrease in "Relative Viscosity" (following the initial rise in "Relative Viscosity") falls to a value at least below 10, whereupon the preheater residence time is terminated and the solution is cooled and passed to the dissolver stage which is maintained at a lower temperature to prevent the "Relative Viscosity" from again rising above 10. Normally, the decrease in "Relative Viscosity" will be allowed to proceed to a value less than 5 and preferably to the range of 1.5 to 2. The conditions in the preheater are such that the "Relative Viscosity" will again increase to a value above 10, absent abrupt termination of preheater exit conditions, such as a forced lowering of temperature.

When a slug of hydroaromatic solvent and coal first experience heating in the preheater, the first reaction product is a gel which is formed in the temperature range 200° to 300° C. Formation of the gel accounts for the first increase in "Relative Viscosity". The gel forms due to bonding of the hydroaromatic compounds of the solvent with the hydrocarbonaceous material in the coal and is evidenced by a swelling of the coal. The bonding is probably a sharing of the solvent hydroaromatic hydrogen atoms between the solvent and the coal as an early stage in transfer of hydrogen from the solvent to the coal. The bonding is so tight that in the gel stage the solvent cannot be removed from the coal by distillation. Further heating of a slug in the preheater to 350° C. causes the gel to decompose, evidencing completion of hydrogen transfer, producing a deashed solid coal, liquid coal and gaseous products and causing a decrease in "Relative Viscosity".

A decrease of "Relative Viscosity" in the preheater is also caused by depolymerization of solvated coal polymers to produce free radicals therefrom. The depolymerization is caused by removal of sulfur and oxygen heteroatoms from hydrocarbonaceous coal polymers and by rupture of carbon-carbon bonds by hydrocracking to convert deashed solid fuel to liquid fuel and gases. The depolymerization is accompanied by the evolution of hydrogen sulfide, water, carbon dioxide, methane, propane, butane, and other hydrocarbons.

At the high temperatures of the preheater outlet zone, repolymerization of free radicals is a reaction which is favored over hydrogenation of free radical sites and accounts for the final tendency towards increase in "Relative Viscosity" in the preheater to a value above 10. This second increase in "Relative Viscosity" is avoided in the present process. The elimination of sulfur and oxygen from the solvated deashed solid fuel is probably caused by stripping out of these materials by thermal rupture of bonds leaving free radical molecular fragments which have a tendency towards subsequent repolymerization at elevated temperature conditions. A drop in stream temperature by forced cooling following the preheater step tends to inhibit polymer formation. The observed low level of sulfur in the liquid coal product, which for one coal feed is about 0.3 weight percent, as compared to 0.7 weight percent in the vacuum bottoms (solid coal) product, indicates that sulfur is being stripped out of the solid fuel product leaving low sulfur smaller molecular fragments as free radicals.

Maximum or exit preheater temperatures should be in the range of 400° to 500° C. The residence time in the preheater for a feed increment to achieve this maximum temperature is about 0.01 to 0.25 hours. At this combination of temperature and residence time, coke formation is not a problem unless flow is stopped, that is, unless the residence time is increased beyond the stated duration. The hydrocarbon gas yield under these conditions is less than about 6 weight percent.

The sulfur content in the vacuum bottoms is relatively low. This is an indication that the reaction proceeds to a high degree of completion. It is also an indication that the vacuum bottoms has been chemically released from the ash so that it can be filtered therefrom.

The hydrogen pressure in the solvent deashing operation is 35 to 300 kg/cm$^2$, generally, and 50 to 200 kg/cm$^2$, preferably. At about 70 kg/cm$^2$ hydrogen pressure, the solvent hydrogen contents tends to adjust to about 6.1 weight percent. If the hydrogen content of the solvent is above this level, transfer of hydroaromatic hydrogen to the dissolved fuel tends to take place, increasing production of liquid fuel, which has a higher hydrogen content than solid fuel. If the solvent contains less than 6.1 weight percent of hydrogen, the solvent tends to acquire hydrogen from hydrogen gas at a faster rate than the fuel product. Once the solvent is roughly adjusted to a stable hydrogen level, conversion appears to depend on the catalytic effect of FeS, derived from the coal ash. Some deviations from this basic situation are observed in response to temperature and time variables. Higher temperatures tend to lower the hydroaromatic content of the system while rapid feed rates may preclude attainment of equilibrium values (not sufficient time). In addition, higher pressures tend to favor more rapid equilibrium and tend to increase the hydroaromatic character of the system.

In the dissolver stage of the deashing process, aromatic compounds which have surrendered hydrogen in the preheater are reacted with hydrogen to again form hydroaromatic compounds. Hydroaromatic compounds are partially (not completely) saturated aromatics. The chemical potential in the dissolver is too low for full saturation of aromatics to be a significant reaction. This is important because while hydroaromatics are capable of hydrogen transfer, saturated aromatics are not. Most of the saturates observed in the dissolver tend to be light products derived from ring opening of liquid product or solvent, or derived from aliphatic side chain removal. Solid coal product aromatic species tend to remain aromatic or hydroaromatic.

The solvent deashing process utilizes the effect of time in conjunction with the effect of temperature in the preheater stage. The desired temperature effect in the preheater stage is substantially a short time effect while the desired temperature effect in the dissolver requires a relatively longer residence time. The desired low preheater residence times are accomplished by utilizing an elongated tubular reactor having a high length to diameter ratio of at least 100, generally, and at least 1,000, preferably, so that rapidly upon reaching the desired maximum preheater temperature the preheater stream is discharged and the elevated temperature can be terminated by forced cooling. Forced cooling can be accomplished by hydrogen quenching or by heat exchange. Thereupon, in the dissolver stage, wherein the temperature is lower, the residence time is extended for a duration which is longer than the preheater residence time.

The data in Table 1, show that there is an adverse effect in employing excessively high preheater temperatures.

TABLE 1

| TEST NUMBER | 1 | 2 | 3 | 4 | 5 |
|---|---|---|---|---|---|
| $H_2$ Pressure, kg/cm² | 70 | 70 | 70 | 70 | 70 |
| Max. Preheater Temp., ° C. | 450 | 500 | 450 | 450 | 475 |
| Dissolver Temp., ° C. | 450 | 450 | 425 | 425 | 425 |
| 1/LHSV: Hr. | 0.52 | 0.98 | 1.79 | 1.89 | 1.79 |
| GHSV | 304 | 239 | 342 | 342 | 342 |
| Solvent/MAF Coal/$H_2O$ (wt) | 2.50/1/0.08 | 2.49/1/0.06 | 2.49/1/0.05 | 2.49/1/.05 | 2.49/1/00 |
| % Ash in Feed Slurry | 5.0 | 5.0 | 5.285 | 7.42 | 10.65 |
| % Coal Derived Feed | 33.3 | 33.3 | 34.8 | 48.7 | 69.9 |
| YIELDS ON MAF COAL BASIS - % | | | | | |
| CO | 0.23 | 0.42 | 0.51 | 0.27 | 0.28 |
| $CO_2$ | 1.12 | 1.20 | 0.64 | 0.68 | 0.28 |
| $H_2S$ | 2.32 | 2.12 | 2.04 | 1.62 | 1.95 |
| Hydrocarbon Gas | 5.28 | 8.89 | 5.73 | 5.80 | 7.11 |
| Gas Not Identified | — | — | — | — | 12.87 |
| $H_2O$ | 3.60 | 4.10 | 3.82 | 1.22 | 1.81 |
| Excess Solvent | 5.36 | 15.10 | 31.98 | 62.08 | 49.37 |
| Vacuum Bottoms | 68.12 | 56.81 | 48.66 | 30.36 | 21.06 |
| Insol. Organic Matter | 14.91 | 13.83 | 11.59 | 4.99 | 9.07 |
| TOTAL | 100.94 | 102.47 | 104.97 | 107.92 | 103.20 |
| DATA | | | | | |
| Recovery, weight % | 97.94 | 96.59 | 95.91 | 92.63 | 93.35 |
| MAF Conversion, weight % | 85.09 | 86.17 | 88.41 | 95.01 | 90.93 |
| COMPOSITION OF LIQUID AND VACUUM BOTTOM FUEL PRODUCT | | | | | |
| Carbon, weight % | 89.68 | — | 89.40 | 89.72 | 90.65 |
| Hydrogen, weight % | 5.94 | — | 5.93 | 6.20 | 6.54 |
| Nitrogen, weight % | 0.979 | — | 1.06 | 1.15 | 1.31 |
| Sulfur, weight % | 0.46 | — | 0.410 | 0.420 | 0.438 |
| Oxygen, weight % | 4.13 | — | 5.00 | 2.51 | 1.062 |
| VACUUM BOTTOMS FUEL PRODUCT COMPOSITION | | | | | |
| Carbon, weight % | 87.32 | 89.03 | 88.54 | 88.71 | 91.12 |
| Hydrogen, weight % | 5.11 | 5.12 | 4.74 | 5.35 | 5.10 |
| Nitrogen, weight % | 1.91 | 2.02 | 2.22 | 2.10 | 2.22 |
| Sulfur, weight % | 0.944 | 0.719 | 0.676 | 0.606 | 0.488 |
| Oxygen, weight % | 4.58 | 3.04 | 3.619 | 3.156 | 1.00 |
| Ash, weight % | 0.133 | 0.067 | 0.205 | 0.078 | 0.075 |

As shown in Table 1, an increase in maximum preheater temperature from 450° C. to 475° C. or 500° C., results in an increased yield of hydrocarbon gases to a level above 6 weight percent based on MAF coal feed. Hydrocarbon gases contain a considerably higher ratio of hydrogen to carbon than either liquid or deashed solid fuel product. Therefore, excessive production of hydrocarbon gases not only signifies a depressed yield of liquid and solid fuel product but also constitutes an unnecessary consumption of valuable process hydrogen due to hydrocracking of higher molecular weight fuel to produce the by-product hydrocarbon gases. Table 1 shows that preheater temperatures of 475° C. and 500° C. both result in a hydrocarbon gas yield above 6 weight percent, while a 450° C. preheater temperature results in a hydrocarbon gas yield below 6 weight percent.

The data in Table 1 also show that in the preheater temperature and residence time conditions can combine to produce either a small or a great excess of solvent above that required in the process, in contravention to the present invention. Excess solvent is produced at the expense of vacuum bottoms yield, converting relatively low hydrogen deashed coal to relatively high hydrogen deashed coal, which is wasteful.

In the dissolver, the reactions occurring generally require a temperature lower than the maximum preheater temperature. Rehydrogenation of the aromatics in the solvent to replenish hydrogen lost from the solvent by hydrogen donation reactions in the preheater requires a longer residence time than is required in the preheater, but proceeds at a temperature lower than the preheater temperature. After the solvent is hydrogenated in the dissolver to reconvert aromatics to hydroaromatics, it is in condition to be recycled to the next preheater pass for hydrogen donation reactions. A coincident reaction which occurs in the dissolver is the removal of additional sulfur from the extracted coal.

The relatively higher preheater temperatures are more effective for sulfur removal than the lower dissolver temperatures. However, some of the sulfur cannot be removed at the low residence time of the preheater, but requires an extended residence time. Therefore, additional sulfur in the coal product is removed during the extended residence time utilized in the dissolver. A third and highly important reaction occurring in the dissolver is the addition of hydrogen to free radicals formed in both the preheater and the dissolver to arrest polymerization of molecular fragments to high molecular weight material.

Table 2 shows the results of preheater tests which were all conducted at 450° C. Certain of the tests were conducted at a very low preheater residence time of 0.035 hours and other tests were performed at somewhat longer preheater residence times. The data of Table 2 show that the precise control of residence time permitted by employing a high length to diameter tubular reactor allows a wide spectrum of negative and positive excess solvent variation in the deashing process, enabling solvent make in the solvation step to be carefully tailored to solvent production in the coker.

TABLE 2

| TEST NUMBER | 1 | 2 | 3 | 4 |
|---|---|---|---|---|
| $H_2$ Pressure, kg/cm² | 70 | 70 | 70 | 70 |
| Max. Preheater Temp., ° C. | 450 | 450 | 450 | 450 |
| LHSV | 28.36 | 28.35 | 15.23 | 7.74 |
| GHSV | 3035 | 2953 | 3012 | 3083 |
| 1/LHSV: Hr. | 0.035 | 0.035 | 0.066 | 0.129 |
| YIELDS ON MAF COAL BASIS - % | | | | |
| CO | 0.03 | 0.07 | 0.06 | 0.25 |
| $CO_2$ | 0.35 | 0.35 | 0.45 | 0.51 |
| $H_2S$ | 0.94 | 1.73 | 1.49 | 2.66 |
| Hydrocarbon Gas | 0.31 | 0.21 | 0.65 | 0.76 |
| $H_2O$ | 0.66 | 1.11 | 0.91 | −0.12 |
| Excess Solvent | −38.47 | −39.61 | 7.84 | 11.80 |

TABLE 2-continued

| TEST NUMBER | 1 | 2 | 3 | 4 |
|---|---|---|---|---|
| Vacuum Bottoms | 65.57 | 105.31 | 75.78 | 69.93 |
| Insoluble Organic Matter | 71.06 | 31.34 | 13.21 | 15.23 |
| TOTAL | 100.45 | 100.55 | 100.39 | 101.02 |
| DATA | | | | |
| Recovery, weight % | 94.14 | 96.80 | 90.68 | 95.94 |
| MAF Conversion, weight % | 28.94 | 68.66 | 86.79 | 84.77 |
| VACUUM BOTTOMS FUEL PRODUCT PROPERTIES | | | | |
| Carbon, weight % | — | — | — | 84.00 |
| Hydrogen, weight % | — | — | — | 5.71 |
| Nitrogen, weight % | — | — | — | 1.93 |
| Sulfur, weight % | — | — | — | 1.38 |
| Oxygen, weight % | — | — | — | 6.59 |
| Ash, weight % | — | — | — | 0.39 |

As shown in Table 2, at the lowest residence time tests there is a net loss of liquid solvent (solvent is consumed due to binding of the solvent in a gel), so that there is insufficient solvent to meet recycle requirements. Also the percent conversion of MAF coal is low in the low residence time tests. However, at the higher residence times indicated in Table 2 there is a net production of solvent, so that more solvent is produced than is required for recycle, and the precent conversion of MAF coal is considerably higher. Therefore, it is apparent that while excess preheater residence time is detrimental in that excess solvent is produced, a deficiency in residence time in the preheater at a particular preheater temperature is also undesirable in that the process cannot sustain solvent needs even considering solvent make in the coker step. Although solvent will be supplied from an external source at process start-up, the preheater temperature and residence time should be established so that once the process achieves equilibrium the solvent deashing process will be deficient in satisfying its own solvent requirements only to the extent that the solvent yield from the downstream coker can make up the deficiency. The data of Table 2 show that the tubular reactor permits a wide variation in solvent yield in the deashing step to respond to solvent yield in the coker.

The data in Table 3 further illustrate the interchangeability of time and temperature upon solvent yield in preheater operation.

Table 3 shows a test performed at 475° C. employing the very low preheater residence time of 0.036 hour in which there is a net loss of solvent in the process. The loss is probably caused by the solvent being bonded in a gel with the coal from which the solvent has insufficient time to become disengaged, and from which the solvent cannot be separated by distillation. However, Table 3 shows that at 475° C. there is a net production of solvent in the process when the preheater residence time is increased. Table 3 further shows that if the temperature is increased to 500° C. the residence time can be reduced again while obtaining a high production of solvent in the process. Table 3 clearly shows the high dependence of solvent yield upon both preheater time and temperature.

Table 4 shows tests performed at a relatively mild preheater temperature of 450° C. As shown in Table 4, even at the moderate preheater temperature of 450° C., lengthy preheater residence times result in hydrocarbon gas yields above 6 weight percent as well as in high solvent yields. Table 4 shows that as preheater residence times increase from about 0.5 to about 1.3 hours at a constant preheater temperature of 450° C. the yield of vacuum bottoms (solid coal) product gradually decreases while the yield of solvent (liquid coal) product gradually increases, together with a disadvantageous increase in hydrocarbon gas yield. Table 4 shows that a 450° C. preheater temperature coupled with a low residence time results in a low yield of hydrocarbon gases. These data illustrate the effect of preheater residence time and indicate that with increasing preheater residence time at a preheater temperature of 450° C, there is a continuous conversion of vacuum bottoms product to solvent product, accompanied by a continuous conversion of product to hydrocarbon gases.

Tables 3 and 4 show that formation of solventinsoluble organic matter is temperature dependent. Solventinsoluble organic matter tends to be produced by free radical polymerization in the process and its formation decreases the desired product. Its formation tends to be higher in the 500° C. tests than in the 450° C. tests, even though the preheater residence times are very long in the 450° C. tests. Furthermore, very careful

TABLE 3

| TEST NUMBER | 1 | 2 | 3 | 4 | 5 | 6 |
|---|---|---|---|---|---|---|
| $H_2$ Pressure, kg/cm² | 70 | 70 | 70 | 70 | 70 | 70 |
| Max. Preheater Temp., ° C. | 475 | 475 | 475 | 500 | 500 | 450 |
| LHSV | 27.57 | 13.65 | 7.81 | 28.36 | 7.68 | 7.74 |
| GHSV | 3102 | 3126 | 3095 | 2988 | 3066 | 3083 |
| 1/LHSV: Hr. | 0.036 | 0.073 | 0.128 | 0.035 | 0.130 | 0.129 |
| YIELDS ON MAF COAL BASIS - % | | | | | | |
| CO | 0.14 | 0.36 | 0.25 | 0.17 | 0.13 | 0.25 |
| $CO_2$ | 0.46 | 0.58 | 0.63 | 0.66 | 0.77 | 0.51 |
| $H_2S$ | 1.57 | 2.59 | 2.01 | 1.77 | 2.94 | 2.66 |
| Hydrocarbon Gas Product | 0.62 | 1.29 | 3.27 | 1.85 | 5.11 | 0.76 |
| $H_2O$ | −2.43 | 0.29 | 0.63 | −1.50 | 0.64 | −0.12 |
| Excess Solvent (Liquid Coal Product) | −11.13 | 13.09 | 17.11 | 13.43 | 25.45 | 11.80 |
| Vacuum Bottoms (Solid Coal Product) | 101.97 | 69.57 | 63.15 | 71.17 | 52.56 | 69.93 |
| Insoluble Organic Matter | 9.09 | 13.38 | 14.21 | 12.83 | 13.17 | 15.23 |
| TOTAL | 100.29 | 101.15 | 101.26 | 100.38 | 100.77 | 101.02 |
| DATA | | | | | | |
| Recovery, weight % | 99.85 | 98.30 | 96.75 | 98.38 | 96.79 | 95.94 |
| MAF Conversion, weight % | 90.91 | 86.62 | 85.79 | 87.17 | 86.83 | 84.77 |
| VACUUM BOTTOMS (SOLID FUEL) PROPERTIES | | | | | | |
| Carbon, weight % | — | 84.62 | 84.87 | 86.67 | 88.30 | 84.00 |
| Hydrogen, weight % | — | 5.56 | 5.42 | 5.33 | 4.96 | 5.71 |
| Nitrogen, weight % | — | 1.90 | 2.04 | 1.78 | 2.10 | 1.93 |
| Sulfur, weight % | — | 1.34 | 1.29 | 1.21 | 0.80 | 1.38 |
| Oxygen, weight % | — | 6.23 | 5.42 | 4.90 | 4.19 | 6.59 |
| Ash, weight % | — | 0.35 | 0.96 | 0.11 | 0.15 | 0.39 |

control of residence time in the preheater at 500° C. operation is required if plugging of the tubular preheater due to coke formation is to be avoided, which is a less severe problem in 450° C. operation.

Table 4 shows data to illustrate the effect upon product sulfur level when increasing residence time in the preheater at a constant preheater temperature of 450° C.

TABLE 4

| TEST NUMBER | 1 | 2 | 3 | 4 | 5 |
|---|---|---|---|---|---|
| $H_2$ Pressure, kg/cm² | 70 | 70 | 70 | 70 | 70 |
| Max. Preheater Temp., ° C. | 450 | 450 | 450 | 450 | 450 |
| LHSV | 1.96 | 1.91 | 1.34 | 1.09 | 0.74 |
| GHSV | 208 | 225 | 231 | 228 | 235 |
| 1/LHSV: Hr. | 0.510 | 0.524 | 0.746 | 0.917 | 1.351 |
| YIELDS ON MAF COAL BASIS - % | | | | | |
| CO | 0.21 | 0.18 | 0.47 | 0.25 | 0.37 |
| $CO_2$ | 1.26 | 1.11 | 1.45 | 1.02 | 1.37 |
| $H_2S$ | 1.74 | 2.58 | 1.50 | 2.42 | 2.86 |
| Hydrocarbon Gas Product | 4.89 | 3.86 | 6.31 | 5.34 | 8.83 |
| $H_2O$ | 6.00 | 7.08 | 1.81 | 3.75 | 2.30 |
| Excess Solvent (Distillate Coal Product) | 6.00 | 11.73 | 14.74 | 16.98 | 18.97 |
| Vacuum Bottoms (Solid Coal Product) | 69.78 | 65.02 | 64.36 | 61.32 | 58.83 |
| Insoluble Organic Matter | 11.10 | 10.62 | 10.60 | 10.12 | 9.64 |
| TOTAL | 100.98 | 102.18 | 101.24 | 101.20 | 103.17 |
| DATA | | | | | |
| MAF Conversion, weight % | 88.90 | 89.38 | 89.40 | 89.88 | 90.36 |
| VACUUM BOTTOMS PROPERTIES | | | | | |
| Carbon, weight % | 87.94 | 86.85 | 87.57 | 87.57 | 88.57 |
| Hydrogen, weight % | 5.07 | 5.47 | 5.44 | 5.37 | 5.24 |
| Nitrogen, weight % | 2.02 | 2.07 | 1.96 | 2.01 | 2.01 |
| Sulfur, weight % | 1.04 | 1.01 | 0.85 | 0.80 | 0.70 |
| Oxygen, weight % | 3.82 | 4.46 | 4.05 | 4.00 | 3.36 |
| Ash, weight % | 0.11 | 0.14 | 0.13 | 0.25 | 0.12 |
| H/C Atomic Ratio | 0.346 | 0.379 | 0.373 | 0.368 | 0.355 |

As shown in Table 4, the percent MAF conversion is substantially maximized at all the residence times tested. However, product sulfur yields advantageously decrease with increasing residence times.

Table 5 shows the results obtained when varying the outlet or maximum preheater temperature without varying total preheater residence time.

TABLE 5

| TEST NUMBER | 1 | 2 | 3 | 4 | 5 |
|---|---|---|---|---|---|
| $H_2$ Pressure, kg/cm² | 70 | 70 | 70 | 70 | 70 |
| Max. Preheater Temp., ° C. | 200 | 300 | 350 | 400 | 450 |
| LHSV | 28.09 | 28.09 | 27.96 | 28.36 | 28.36 |
| GHSV | 2978 | 2978 | 2978 | 2987 | 3035 |
| 1/LHSV: Hr. | 0.035 | 0.035 | 0.036 | 0.035 | 0.035 |
| YIELDS ON MAF COAL BASIS - % | | | | | |
| CO | 0.00 | 0.00 | 0.00 | 0.24 | 0.03 |
| $CO_2$ | 0.07 | 0.14 | 0.11 | 0.28 | 0.35 |
| $H_2S$ | 0.04 | 0.07 | 0.07 | 0.66 | 0.94 |
| Hydrocarbon Gas Product | 0.00 | 0.00 | 0.00 | 0.03 | 0.31 |
| $H_2O$ | −0.95 | 0.25 | 0.35 | 0.87 | 0.66 |
| Excess Solvent (Liquid Coal Product) | −153.91 | −172.38 | −134.95 | −129.56 | −38.47 |
| Vacuum Bottoms (Solid Coal Product) | 147.91 | 193.61 | 167.60 | 187.58 | 65.57 |
| Insoluble Organic Matter | 106.84 | 78.52 | 67.03 | 40.21 | 71.06 |
| TOTAL | 100.00 | 100.21 | 100.21 | 100.31 | 100.45 |
| DATA | | | | | |
| Recovery, weight % | 95.21 | 118.58 | 27.02 | 92.19 | 94.14 |
| MAF Conversion, weight % | −6.84 | 21.48 | 32.97 | 59.79 | 28.94 |

As shown in Table 5, at a constant residence time of 0.035 hour, solvent is consumed due to gel formation at low preheater temperatures. The solvent loss tends to diminish with elevation of preheater temperatures, but even at higher preheater temperatures the employment of extremely low residence times does not permit complete breaking of the gel and release of the solvent. The data of Table 5 show that adequate residence time must elapse to permit the deashing to produce sufficient solvent which when combined with coker liquid will be equal to about 100 percent of deashing solvent requirements.

Table 6 shows the results of tests conducted with maximum preheater temperatures of 450° C. and 500° C. and with variable preheater residence times.

Table 6

| TEST NUMBER | 1 | 2 | 3 | 4 |
|---|---|---|---|---|
| $H_2$ Pressure, kg/cm² | 70 | 70 | 70 | 70 |
| Max. Preheater Temp., ° C. | 450 | 450 | 450 | 500 |
| LHSV | 28.36 | 28.35 | 15.23 | 28.36 |
| GHSV | 2964 | 2953 | 3012 | 2988 |
| 1/LHSV: Hr. | 0.035 | 0.035 | 0.066 | 0.035 |
| YIELDS ON MAF COAL BASIS - % | | | | |
| CO | 0.03 | 0.07 | 0.06 | 0.17 |
| $CO_2$ | 0.35 | 0.35 | 0.45 | 0.66 |
| $H_2S$ | 0.97 | 1.73 | 1.49 | 1.77 |
| Hydrocarbon Gas Product | 0.31 | 0.21 | 0.65 | 1.85 |
| $H_2O$ | −1.42 | 1.11 | 0.91 | −1.50 |
| Excess Solvent (Liquid Coal Product) | −29.30 | −39.61 | 7.84 | 13.43 |
| Vacuum Bottoms (Solid Coal Product) | 136.21 | 105.31 | 75.78 | 71.17 |
| Insoluble Organic Matter | 23.20 | 31.34 | 13.21 | 12.83 |
| TOTAL | 100.35 | 100.55 | 100.39 | 100.38 |
| DATA | | | | |
| Recovery, weight % | 95.46 | 96.80 | 90.68 | 98.38 |
| MAF Conversion, weight % | 76.80 | 68.66 | 86.79 | 87.17 |
| VACUUM BOTTOMS (SOLID FUEL) PROPERTIES | | | | |

Table 6-continued

| TEST NUMBER | 1 | 2 | 3 | 4 |
|---|---|---|---|---|
| Carbon, weight % | — | — | — | 86.67 |
| Hydrogen, weight % | — | — | — | 5.33 |
| Nitrogen, weight % | — | — | — | 1.78 |
| Sulfur, weight % | — | — | — | 1.21 |
| Oxygen, weight % | — | — | — | 4.90 |
| Ash, weight % | — | — | — | 0.11 |
| H/C Atomic Ratio | — | — | — | 0.369 |

As shown in Table 6, at the preheater temperature of 450° C. and the low residence time of 0.035 hour, there is a net consumption of solvent. Table 6 shows that the preheater is capable of a net production of solvent either by lengthening the residence time at a preheater temperature of 450° C. or by increasing the final preheater temperature to 500° C., without increasing the residence time. Table 6 illustrates the interchangeability of preheater temperature and preheater residence time upon relative production of liquid and solid product in the tubular preheater.

FIGS. 1 through 6 illustrate the effects of varying certain parameters in the solvent deashing process employing a tubular preheater.

FIG. 7 presents a schematic diagram of the combination solvent deashing and coking process of this invention.

FIG. 1 shows the relationship between percent conversion of MAF coal and maximum preheater temperature at a space time of 0.035 hour. FIG. 1 shows that very high yields are obtained at temperatures of at least 450° C. at a constant low residence time.

FIG. 2 shows percent conversion of MAF coal as a function of residence time in the tubular preheater. FIG. 2 is based on data taken at 450° C. and shows that substantially maximum conversion (above 80 or 85 percent) is achieved very quickly in the preheater and that continuance of preheater holding time for a considerably greater duration has a very small effect on total conversion. Therefore, at a 450° C. preheater temperature, after about 0.05 or 0.1 hour the preheater time is substantially removed as a process factor in regard to conversion.

FIG. 3 shows the sulfur content in the deashed coal as a function of total preheater and dissolver residence time at various maximum preheater temperatures. FIG. 3 shows that residence time exerts a greater effect on sulfur level in the vacuum bottoms at high temperatures than at low temperatures. FIG. 3 shows that if significant sulfur is to be removed without utilizing relatively high temperatures, a prolonged residence time must accompany low temperature operation.

As shown in FIG. 4, a high level of sulfur removal is least dependent upon residence time at elevated temperatures while residence time becomes increasingly important to a high level of sulfur removal at lower temperatures.

Figure 2:
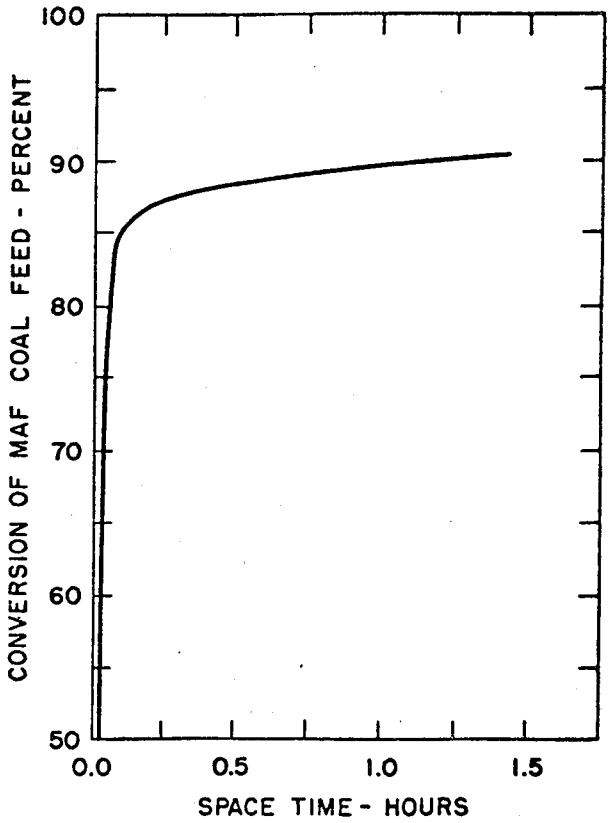
Figure 1:
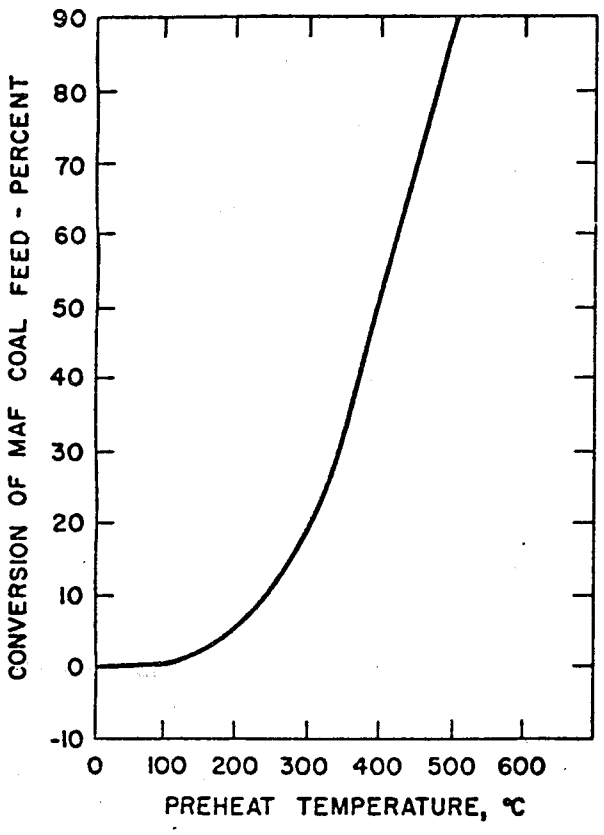
Figure 4:
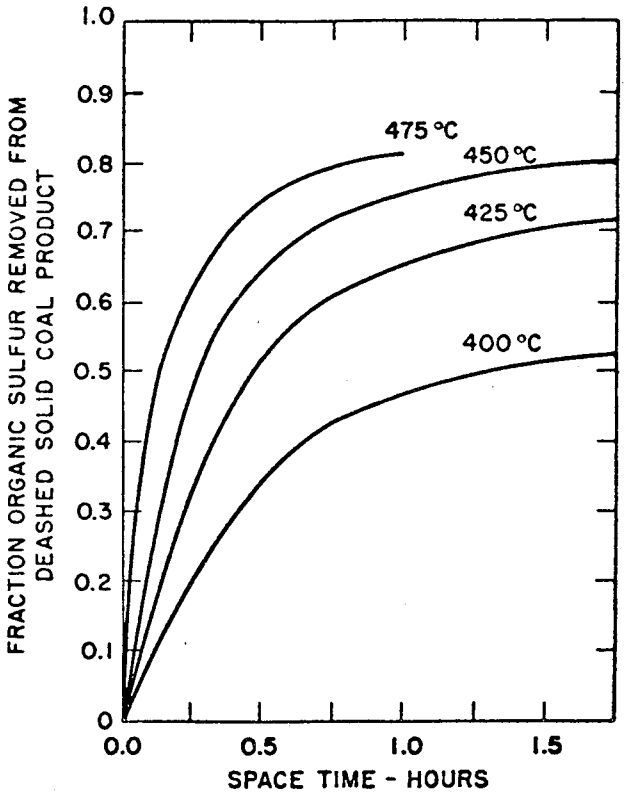
FIG. 4 shows the fraction of organic sulfur removed from the vacuum bottoms versus residence time at various temperatures.
Figure 3:
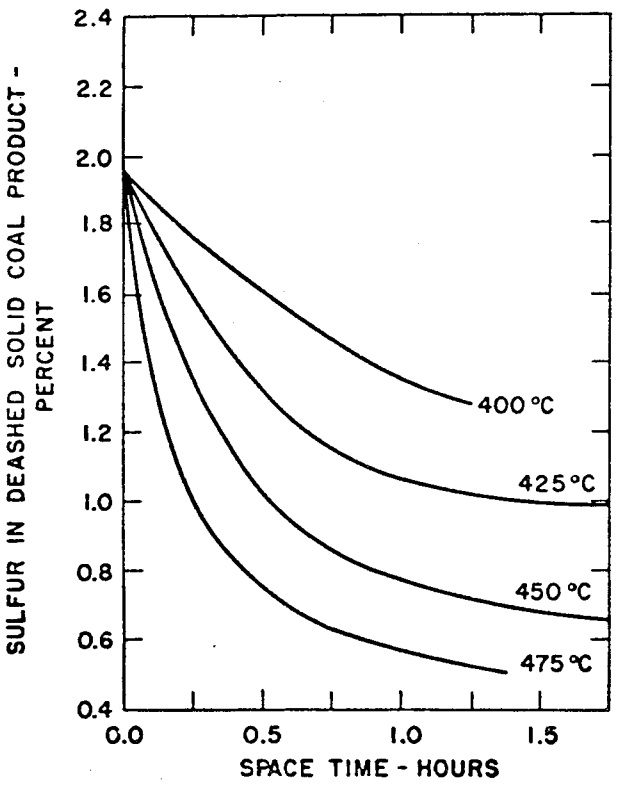
Figure 6:
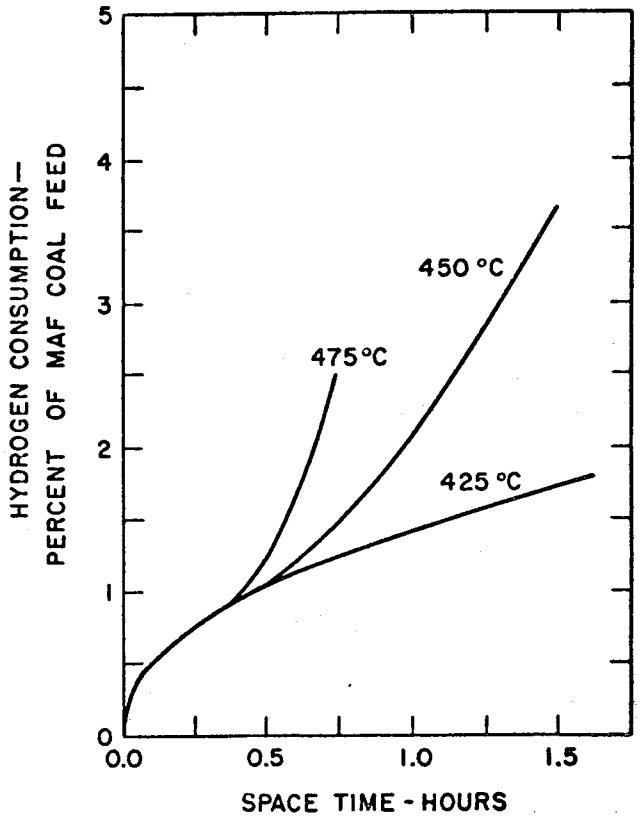
Figure 5:
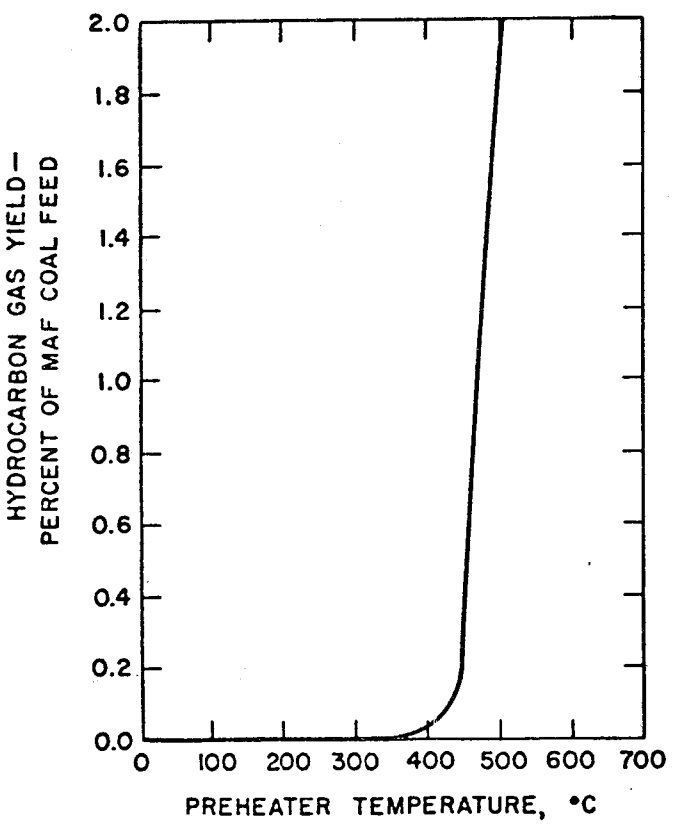
FIG. 5 illustrates the relationship of hydrocarbon gas yield to preheater outlet temperature at 0.035 hours and shows that hydrocracking to gases increases rapidly as the temperature is increased above 400° C., and especially above 450° C. Production of hydrocarbon gases constitutes an undesirable consumption of hydrogen.

FIG. 6 illustrates the effect of temperature and residence time on hydrogen consumption in the solvent deashing process and shows that at low residence times hydrogen consumption is not affected by temperature but that at higher residence times (above 0.4 or 0.5 hours) hydrogen consumption is affected by considerably by temperature. Either low residence time or low temperature favors low hydrogen consumption. As shown in FIG. 6, at progressively increasing temperatures from 425° to 475° C., the increase in hydrogen consumption with increasing space-time is extremely rapid, indicating the onset of hydrocracking. FIG. 6 illustrates the criticality for hydrogen economy in delaying any production of liquid product which requires elevated temperatures until a subsequent thermal coking step. The reason is that increasing cracking temperatures in the presence of hydrogen increases hydrogen consumption while increasing cracking temperatures in the absence of hydrogen increases hydrogen production. Therefore, the coking step is peformed at a temperature above the highest temperature employed in the solvent deashing process so that liquid solvent is produced with a concomitant production of hydrogen, which is, in effect, a regeneration of a portion of the hydrogen consumed in the solvent deashing process.

Figure 7:
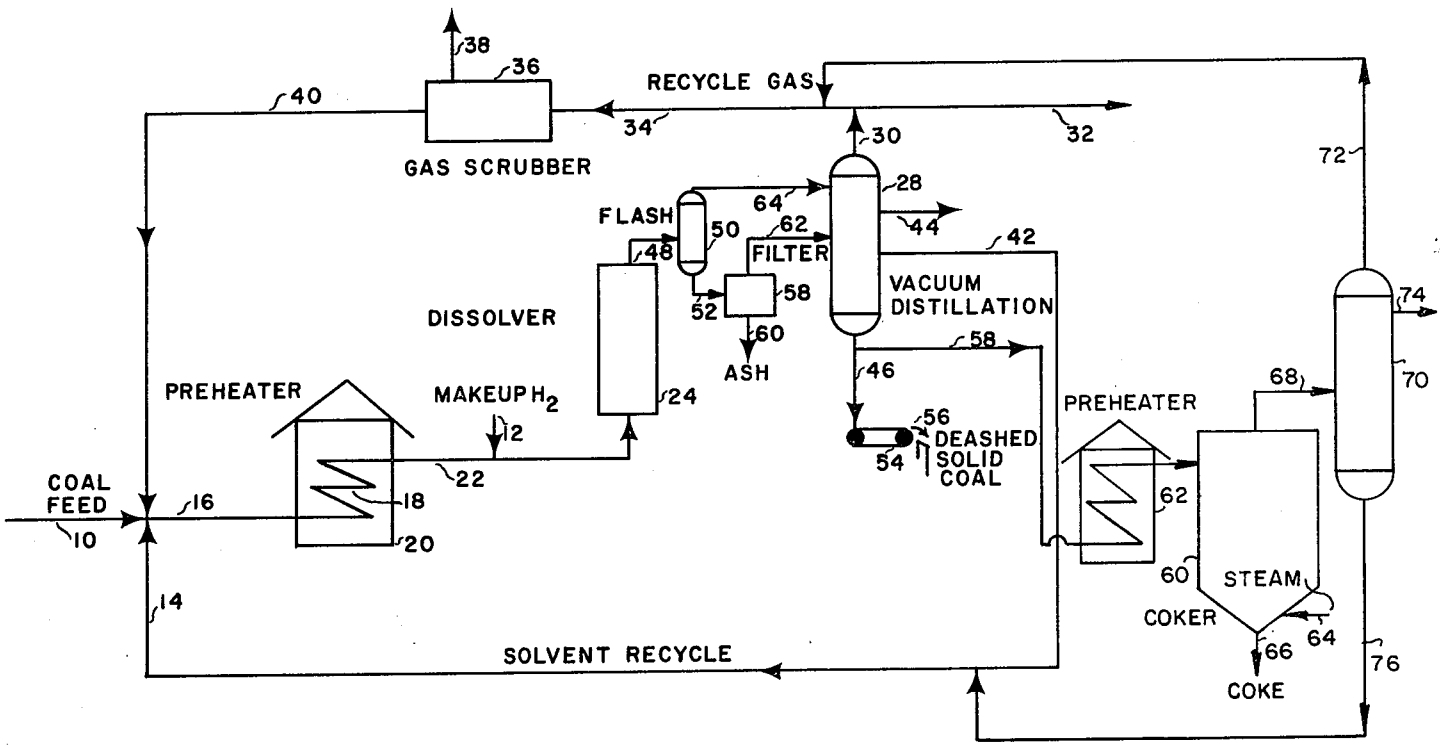

FIG. 7 shows schematically the process of the present invention. As shown in FIG. 7, pulverized coal is charged to the process through line 10, contacted with recycle hydrogen from line 40, and forms a slurry with recycle solvent which is charged through line 14. The slurry passes through line 16 to solvent deashing preheater tube 18 having a high length to diameter ratio which is greater than 100, generally, and, preferably, greater than 1,000 to permit plug flow. Preheater tube 18 is disposed in a furnace 20 so that in the preheater the temperature of a plug of feed slurry increases from a low inlet value to a maximum temperature at the preheater outlet.

The high temperature effluent slurry from the preheater is then passed through line 22 where it is cooled before reaching dissolver 24 by the addition of cold makeup hydrogen through line 12. Other methods for cooling can include water injection, a heat exchanger or any other suitable means. The residence time in dissolver 24 is substantially longer than the residence time in preheater 18 by virtue of the fact that the length to diameter ratio is considerably lower in dissolver 24 than in preheater 18, causing backmixing and loss of plug flow. The slurry in dissolver 24 is at substantially a uniform temperature whereas the slurry in preheater 18 increases in temperature from the inlet to the exit end thereof.

The slurry leaving dissolver 24 passes through line 48 to flash chamber 50 from which a lighter overhead stream passes through line 64 to vacuum distillation column 28 while ash-containing heavy fuel is removed as flash residue through line 52 and passed to filter 58. Ash is removed from the flash residue through line 60 while the deashed residue is passed to vacuum distillation column 28 through line 62.

Gases, including hydrogen for recycle, are removed overhead from distillation column 28 through line 30 and are either withdrawn from the process through line 32 or passed through line 34 to scrubber 36 to remove impurities through line 38 and prepare a purified hydrogen stream for recycle to the next pass through line 40.

All the distillate liquid boiling above about 200° or 260° C. produced in the solvent deashing process is removed from a mid-region of distillation column 28 through line 42. A liquid fraction, including naphtha, boiling lower than the solvent boiling range is removed from the distillation column through line 44. Since the solvent deashing process produces insufficient solvent liquid for the next pass, not only is the entire volume of solvent range liquid in line 42 recycled through line 14, but this volume is blended with a coker solvent stream, entering through line 76.

Vacuum bottoms is removed from distillation column 28 through line 46 and can be, in part, passed to moving conveyor belt 54. On conveyor belt 54 the bottoms product is cooled to room temperature, at which temperature it solidifies. Deashed solid coal containing as low an ash content as is practical is removed from conveyor belt 54 by a suitable belt scrapper means, as indicated at 56.

A portion of the vacuum bottoms flowing in line 46, which can be a major or a minor portion, or about onehalf, is diverted through line 58 through preheater 62 to delayed thermal coker drum 60. If desired, all of the vacuum bottoms in line 46 can be passed to coker 60. In preheater 62, the vacuum bottoms is heated to a temperature between about 485° and 510° C. before reaching the coker. This temperature is higher than the maximum temperature used in the dissolver stage. Steam is added to coker 60 through line 64 and coke is removed through line 66. Hydrogen is not added to the coker. Coker 60 is operated at any convenient low pressure, such as 1.7 to 2.8 kg/cm$^2$. Liquid and gaseous product from coker 60 is passed overhead through line 68 at a temperature of about 425° to 460° C. to distillation column 70.

Distillation column 70 discharges a hydrogen-containing gaseous stream overhead through line 72 to line 34 and gas scrubber 36 to supply hydrogen produced in coker 60 for recycle to the solvent deashing process. Thirty percent of process hydrogen requirements can pass through line 72. A liquid product, including naphtha, boiling below 200° or 260° C., is removed from the process through line 74. The liquid produced in coker 60 boiling in the solvent range, which is typically distillate boiling at 200° or 260° C.+, is passed in its entirety through line 76 to line 42 for blending with the solvent liquid in line 42 and for recycle as solvent in the deashing process.

The solvent blend returning to the solvent deashing process through line 14 includes substantially the total solvent boiling range liquid recovered from both the solvent deashing process and the coking process excluding, of course, mechanical and other losses.

EXAMPLE

A deashed coal which is solid at room temperature is recovered from the tubular reactor solvent deashing process having the following specifications.

| | |
|---|---|
| Specific Gravity g/cc | 1.25 |
| Total Sulfur, wt. % max. | 1.0 |
| Nitrogen, wt. % max. | 1.8–2.0 |
| Ash, wt. % | 0.1 |
| Softening Point, ° C. | 170–200 |
| Oxygenated Compounds, wt. % | 3.8 |
| Benzene Insolubles, wt. % | 33 |
| Conradson Carbon, wt. % | 61.21 |
| Ramsbottom Residue, wt. % | 65.57 |
| Viscosity, cp | |
| 260° C. | 500 to 5,000 |
| 288° C. | 140 to 400 |
| 316° C. | 55 to 80 |

This oil is subjected to delayed coking, and the following product mix is recovered from the coker.

| COMPONENT | WT. % ON FEED |
|---|---|
| Gas to $C_3$, including $H_2$ | 4.71 |
| $C_4$'s | 0.29 |
| Distillate ($C_5$ to 199° C.) | 1.0 |
| Distillate (199 to 377° C.) | 22 |
| Coke | 72 |

The entire 199° to 377° C. fraction recovered from the coker and the hydrogen content in the coker gas stream are recycled to the solvent deashing process.

The green coke recovered from the coker can be calcined at an elevated pressure for conversion into electrode coke for aluminum production.

We claim:

1. A process for the conversion of ash-containing raw coal to deashed coke comprising solvent-treating raw coal with recycle solvent liquid in the presence of added hydrogen, said solvent-treatment including passage through a tubular reactor having a length to diameter ratio of at least 100 at a temperature between 400° and 500° C. and a hydrogen pressure between 35 and 300 kg/cm$^2$ to dissolve hydrocarbonaceous material from ash-containing raw coal, separating said hydrocarbonaceous material from said ash, said separated hydrocarbonaceous material comprising a fraction which is solid at room temperature in major proportion together with a first solvent boiling range liquid fraction, operating said solvent-treatment under conditions of temperature and residence time so that the amount of said first solvent boiling range liquid fraction is less than the amount of said recycle solvent liquid, obtaining the remainder of said recycle solvent liquid by heating at least a portion of said solid fraction to a temperature above the highest temperature employed in said solvent-treating step and delay coking said heated solid fraction without added hydrogen to produce deashed coke, a second solvent boiling range liquid fraction and coker hydrogen, recycling said coker hydrogen to said solvent-treatment step, and recycling substantially said entire first and second solvent boiling range liquid fractions to said solvent-treatment step.

2. The process of claim 1 wherein said solvent boiling range is 200° to 540° C.

3. The process of claim 1 wherein said solvent boiling range is 260° to 540° C.

4. The process of claim 1 wherein said solvent boiling range is 200° to 427° C.

5. The process of claim 1 wherein substantially all of the solid fraction from the solvent-treatment is passed to said delayed coking step.

6. The process of claim 1 wherein a portion of the solid fraction from the solvent-treatment is removed from said process as deashed solid coal.

7. The process of claim 1 wherein said solid faction in said heating step prior to said coking step is heated to a temperature in the range 485° to 510° C.

8. The process of claim 1 wherein the highest temperature in said solvent-treatment is below 470° C.

9. The process of claim 1 wherein the weight ratio of said recycled solvent to raw coal is 0.5:1 to 5:1.

10. The process of claim 1 wherein said length to diameter ratio is at least 1,000.

11. The process of claim 1 wherein the residence time in the tubular reactor is between 0.01 and 0.25 hours.

12. The process of claim 1 wherein the hydrocarbon gas yield in said solvent-treatment is less than 6 weight percent.

* * * * *